US006782567B1

(12) United States Patent
Austin et al.

(10) Patent No.: US 6,782,567 B1
(45) Date of Patent: Aug. 31, 2004

(54) FOUNTAIN WATER TOY UTILIZING A BATTERY-POWERED PUMP

(76) Inventors: Linda Austin, 231 Sherman St., Denver, CO (US) 80203; Anne Argent, 3014 Wyandot St., Denver, CO (US) 80211

( * ) Notice: Subject to any disclaimer, the term of this patent is extended or adjusted under 35 U.S.C. 154(b) by 0 days.

(21) Appl. No.: 10/700,097

(22) Filed: Nov. 3, 2003

(51) Int. Cl.[7] ..... A47K 3/22; A47K 3/34; A47K 3/36

(52) U.S. Cl. ..... 4/615; 4/496; 4/567; 4/568

(58) Field of Search ..... 4/496, 509, 559, 4/567, 568, 580, 605, 615, 661

(56) References Cited

U.S. PATENT DOCUMENTS

| | | | | |
|---|---|---|---|---|
| 4,607,400 A | * | 8/1986 | Goodman | 4/496 |
| 4,951,329 A | | 8/1990 | Shaw | |
| 5,385,472 A | | 1/1995 | Mullin | |
| 5,621,928 A | | 4/1997 | Willhight | |
| 5,864,896 A | * | 2/1999 | Ferraro | 4/490 |
| 5,934,557 A | | 8/1999 | Shih | |
| 6,375,090 B1 | | 4/2002 | Beidokhti | |
| 2002/0148908 A1 | | 10/2002 | Linstedt et al. | |

* cited by examiner

*Primary Examiner*—Tuan N. Nguyen
(74) *Attorney, Agent, or Firm*—Leyendecker Lemine & Dak; Kurt Leyendecker

(57) ABSTRACT

A fountain water toy generally for use in a bathtub or pool is described. The toy generally comprises an at least partially submersible pump that is fluidly coupled with a fountain amusement assembly. The assembly includes one or more spouts through which water is streamed. Interchangeable characters heads or other fanciful representations are provided to place over the spouts such that when in operation water streams from the character heads. In one preferred embodiment, the amusement assembly comprises a faceplate assembly that removably mounts to a vertical surface such as the wall of a bathtub enclosure. The faceplate assembly of this preferred embodiment is fluidly connected to the pump through tubing. The pump is powered by a low voltage battery power source and as such there is no threat of shock or serious injury should the batteries that are normally sealed within the pump housing become exposed to the water.

20 Claims, 4 Drawing Sheets

FOUNTAIN WATER TOY UTILIZING A BATTERY-POWERED PUMP

FIELD OF THE INVENTION

This invention relates to water toys, and more particularly, a water toy incorporating a pump-activated fountain.

BACKGROUND

Most infants and young children enjoy playing in water. Young minds are fascinated with the fluid nature of the substance. Further, by examining water and its behaviors when water is subject to different conditions, young children are not only amused, but their young minds are also stimulated by the experience.

There are numerous bath and pool toys on the market that are both fun and stimulating for young children, but in general, there are not many bath or pool toys that spray or project one or more streams of water. Those that do exist typically utilize one of the following sources to provide for the dynamic movement of water: (1) a central pressurized water source via a faucet; (2) gravity such as is used in the bath retainer toy taught in U.S. Pat. No. 5,621,928 and the construction water toy taught in U.S. Pat. No. 5,385,472; and (3) a manually operated pumping device such as is used in the child's play shower taught in U.S. Pat. No. 4,951,329. Each of these sources when associated with a child's toy has disadvantages. For instance, using water from a faucet is potentially wasteful of this increasingly limited natural resource. Further, allowing water to continue to flow into a bathtub could cause the water level in the tub to increase until it is deeper than is safe for the particular child in the tub. Concerning gravity, either a parent or the child must manually lift a container of water into an elevated reserve from which the water flows. The effort necessary to constantly refill the reserve may detract from the continuous enjoyment of a toy's dynamic water features. Like the need to constantly refill a reserve of water when relying upon gravity, the need to manually pump the water is also potentially detracting from the enjoyment of the dynamic water features. Additionally, infants lacking the necessary dexterity and motor skills may not be able to perform the manual tasks required to power the dynamic water features.

AC-powered pumps are well known that can provide the necessary water flow to enable dynamic water features, yet the use of AC power in or near a tub or pool of water that has a child contained therein is generally not wise. Consider that if the wires of an electrical cord that runs through the pool of water is cut or otherwise exposed to the water, approximately 120 volts of electricity with up to 15 amps of current would be passed through the water. This level of electrical energy would seriously injure any person in or touching the water and might even be fatal. Accordingly, no bathtub or pool water toys are known that utilize AC-powered pumps.

Additionally, no bathtub toys are known that utilize DC-powered pumps. There are several potential reasons for this: the typical battery powered pump either does not provide a sufficient amount of flow in gallons per hour (GPH), or the battery or battery pack required to operate the device is too powerful to be safely used in a body of water containing a child.

SUMMARY OF THE INVENTION

A one preferred embodiment of a water toy comprises a battery-powered pump that is at least partially submersible.

The pump is connected to a themed amusement assembly via a fluid conduit. The themed amusement assembly includes at least one spout out of which water streams during the operation of the toy. At least one character is removably mounted over the spout such that water appears to stream from the character during the toy's operation.

Another preferred embodiment of the water toy also comprises a battery-operated pump. The pump is fluidly coupled to a faceplate assembly by way of tubing. The faceplate assembly includes a faceplate with one or more connectors coupled therewith to removably secure the faceplate assembly to a generally vertical surface. The faceplate assembly also includes one or more fluid passages that terminate in an outlet. A portion of the faceplate assembly immediately surrounding the outlet is configured to resemble a character.

Yet another preferred embodiment of the water toy includes a battery operated pump that is at least partially submersible. The pump also includes one or more suction cups adapted to removably secure it to a surface. Tubing fluidly couples the pump with a faceplate assembly. The faceplate assembly comprises a faceplate, at least one spout from which water streams during the toy's operation, one or more suction cups, and a character. The suction cups on the faceplate assembly are adapted to removably secure the faceplate assembly to a generally vertical surface. The character is removably mountable over the spout such that water appears to stream from the character when the toy is in operation.

Numerous other embodiments and variations of the embodiments are also contemplated as is provided in this specification including the appended claims and as would be obvious to one of ordinary skill in the art with the benefit of this disclosure.

DETAILED DESCRIPTION

Figure 1:
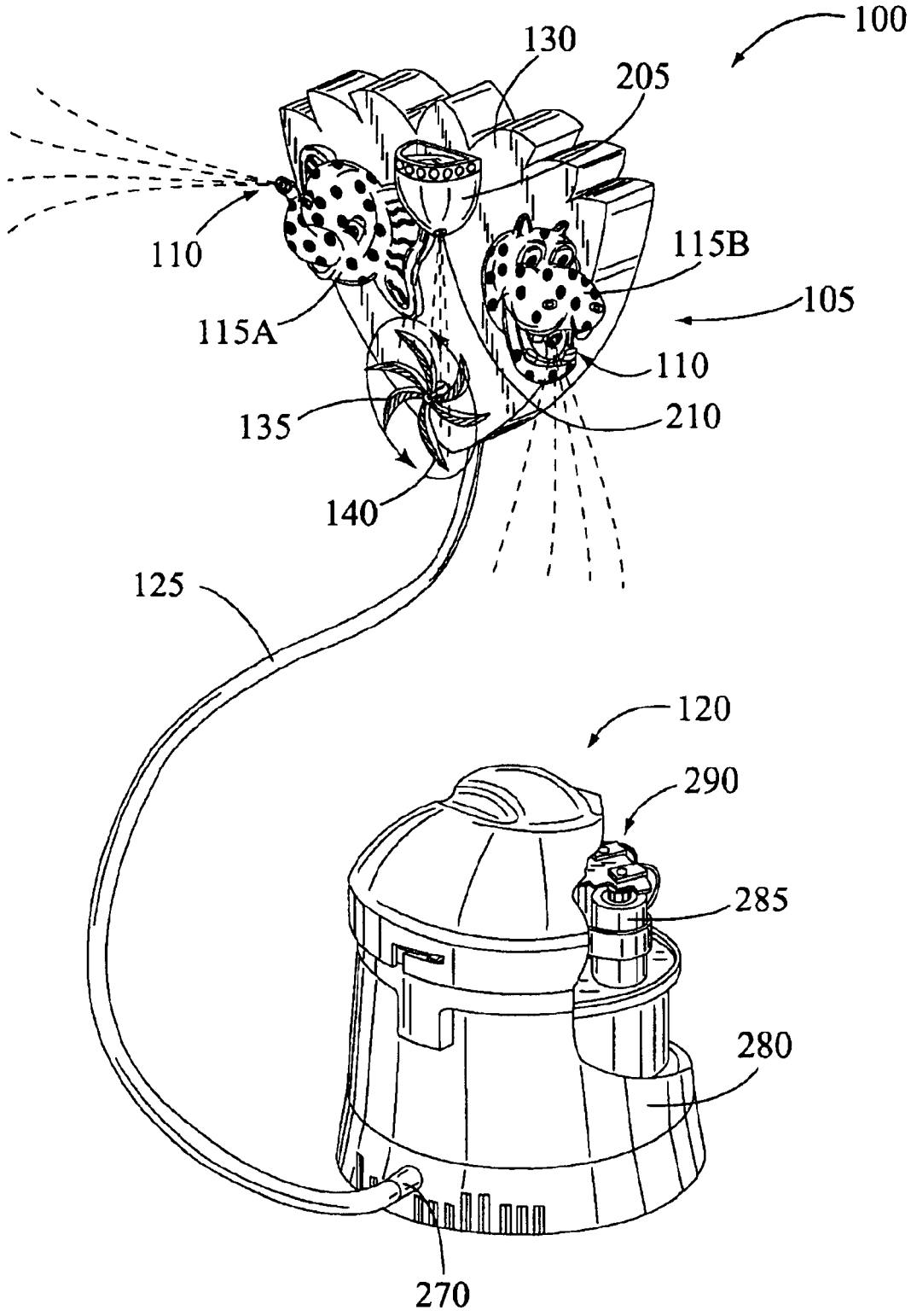
FIG. 1 is an isometric view of a first preferred embodiment of the present invention comprising a pump and a faceplate assembly.

A fountain-type water toy, typically for use by a child in a bathtub or pool, utilizing a battery-powered pump is described. Preferred embodiments of the water toy include one or more water features that stream or spray water from a themed activity center. The activity center can have any variety of themes including but not limited to circus setting, a prehistoric setting, a zoo setting, a jungle setting, a pirate ship, and a scholastic theme involving shapes, numbers or letters. Each activity center is fluidly coupled to the battery powered pump.

In a first preferred embodiment described below, the activity center comprises a faceplate assembly that can be removably secured to a generally vertical surface, such as the wall of a bathtub enclosure. Accordingly, water can be streamed or sprayed outwardly therefrom. A tube carries the water from the pump to the faceplate assembly.

In a second preferred embodiment described below, the activity center rests upon and/or is attached to a pump that is submersed in water such that the activity center in combination with the pump is free standing. For example, when the theme of the activity center is a pirate ship, the ship appears to be floating on the surface of the water, but is in actuality resting on the pump. A tube can be used to fluidly connect the attached activity center to the outlet of the pump or a fluid conduit molded or otherwise formed in the attached activity center may couple directly with the pump's outlet.

The water features typically include removable characters from which the stream or spray of water appears to project, although in alternative embodiments, the characters can be integrally molded with the activity center. Characters typically vary accordingly to the theme in which they are associated. For example, in the jungle theme, the heads of jungle animals such as a Giraffe, elephant, or hippopotamus may comprise the characters; whereas, in the scholastic themed activity center, the characters may comprise various shapes such as a circle or a square. In the preferred embodiments, the characters may be interchanged with each other by fitting them to mounts on a base portion or faceplate of the activity center adding additional versatility to the toy, and thereby decreasing the likelihood a child will lose interest in the toy.

In the preferred embodiments, the pump is at least partially submersible in a pool of water such as can be contained in a bathtub, a swimming pool or wading pool for example. Typically, the pump rests on a generally horizontal surface such as the bottom of a tub. The pump may be weighted or it may include a suction cup(s) to hold it in place. One of the significant features of the pump in the preferred embodiments is its use of battery power, most preferably low voltage battery power. By utilizing standard low voltage cells that have low current output, there is little risk of any children playing in the water where the pump is located being shocked, even if the pump housing is somehow breached and the batteries are exposed to the water. Accordingly, unlike high-energy battery operated pumps using high current output 12-volt type batteries and AC-powered pumps, the low wattage battery operated pump is safe to use in bodies of water that also contain babies or children. The preferred embodiment uses a pump having a flow rate of about 200 gallons per hour when the water outlets or spouts are vertically level with the pump outlet and an output of 125 gallons per hour when the spouts are up to about two feet above the pump outlet.

Terminoloy

The term "or" as used in this specification and the appended claims is not meant to be exclusive rather the term is inclusive meaning "either or both".

The term "coupled" refers to two or more elements that are connected together but not necessarily directly connected together. For example, a battery is electrically coupled to a motor even though the battery is not in direct contact with the motor if there is an intervening set of electrical wires connected to both the motor and the battery.

The term "character" as used in this specification refers to any representation of an animate or inanimate object or a portion thereof that is in some manner set apart from its surroundings. In general, although not necessarily exclusively, characters as used by the preferred embodiments of the described water toy are associated with the toy's water features. For example, the head of an elephant, wherein water spouts out of its trunk, would be a character in a jungle themed activity center, and in a tea party themed activity center, a teapot, wherein water flows from its spout when the toy is operating, may also be a character. Although in several embodiments the characters are removable from a base portion or a faceplate of the activity center, they need not be in other embodiments and can be integrally molded therein.

The activity center of the water toy and its variations are referred to as either or both of "themed" and "fanciful" in the description and the claims. Each of these terms indicate that the activity centers of the preferred embodiments are representations of scenes, situations, or characters, either based partially on reality or drawn from imaginary constructs. For example, the themes of an activity center of an embodiment of the water toy could include, but are not limited to: an aquatic theme with aquatic animal characters; a dinosaur theme with dinosaur characters; a funny face theme with clown face characters; a scholastic shape theme with characters representing various shapes; a zoo theme with various animal or animal head characters; a pirate ship with pirate and pirate implements as characters; a flower pot scene with flower and plant characters; and a tea party theme with cup and teapot characters. In embodiments of the water toy, the themed activity centers are fanciful in that the scenes are not true to life miniature representations. Rather artistic license may be taken concerning such things as perspective, size and depiction of certain scene elements and characters. For example, animal characters may be depicted as smiling when in real life they do not smile, or a teapot character may be represented as having a face.

A First Preferred Embodiment

Figure 2:
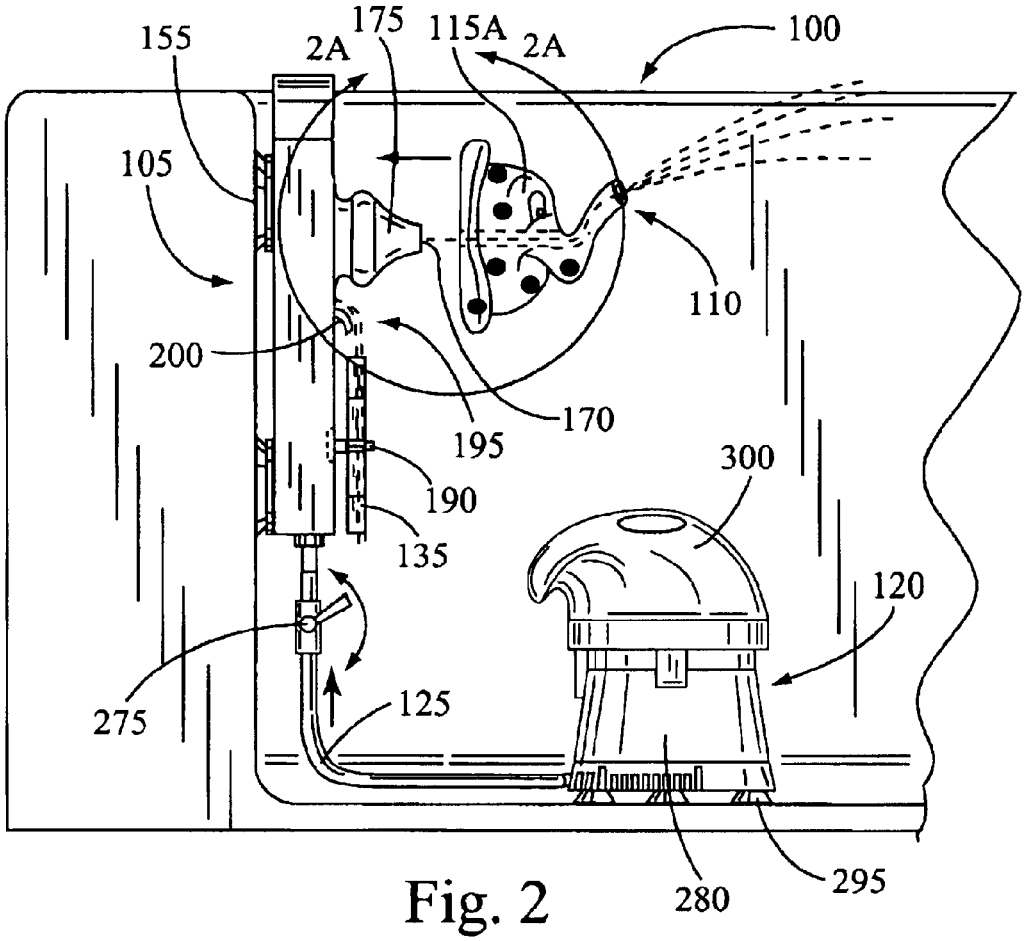
FIG. 2 is a side view of one variation of the first preferred embodiment showing the faceplate assembly attached to the vertical surface of a bathtub.

A first preferred embodiment 100 of the present invention is illustrated in FIGS. 1–4. Specifically referencing FIGS. 1 & 2, the first preferred embodiment generally comprises: a faceplate assembly 105 including water features 110 and removable characters 115; a separate battery-powered fluid pump 120 that is at least partially submersible in water; and tubing 125 connecting the faceplate assembly and its water features to the pump. The faceplate assembly is typically adapted to attach to a vertical surface, such as a wall of a bathtub enclosure as shown in FIG. 2. In operation, water from a pool in which the pump is positioned is pumped through the tubing to the faceplate and out of the faceplate assembly through one or more water outlets (or spouts) 170 of the water features.

The faceplate assembly 105 or portions thereof are illustrated in detail in FIGS. 2, 2A, 3 & 4. The typical faceplate assembly is configured to represent a particular theme in a fanciful manner. For instance, in the illustrated embodiment, a jungle or African theme is presented comprising a faceplate 130 shaped to resemble jungle foliage, a waterwheel character 135 having vanes 140 with the appearance of large leaves, and removable animal head characters 115A & 11 5B resembling an elephant and a hippopotamus respectively. Many other themes are contemplated including, but not limited to: an aquatic theme wherein the characters include one or more of dolphins, sharks, fish, seal, and whales; a dinosaur theme wherein the faceplate resembles foliage from a prehistoric jungle and the characters include one or more types of dinosaurs; a circus theme wherein the faceplate resembles a big top tent and the characters are clown faces; a zoo theme wherein the characters include various zoo animals, and scholastic theme wherein the characters are shapes, numbers or letters. In yet other variations of the preferred embodiment, a faceplate assembly can be targeted at adult individuals with the various characters representing certain anatomical body parts, such as a penis or a breast.

Figure 3:
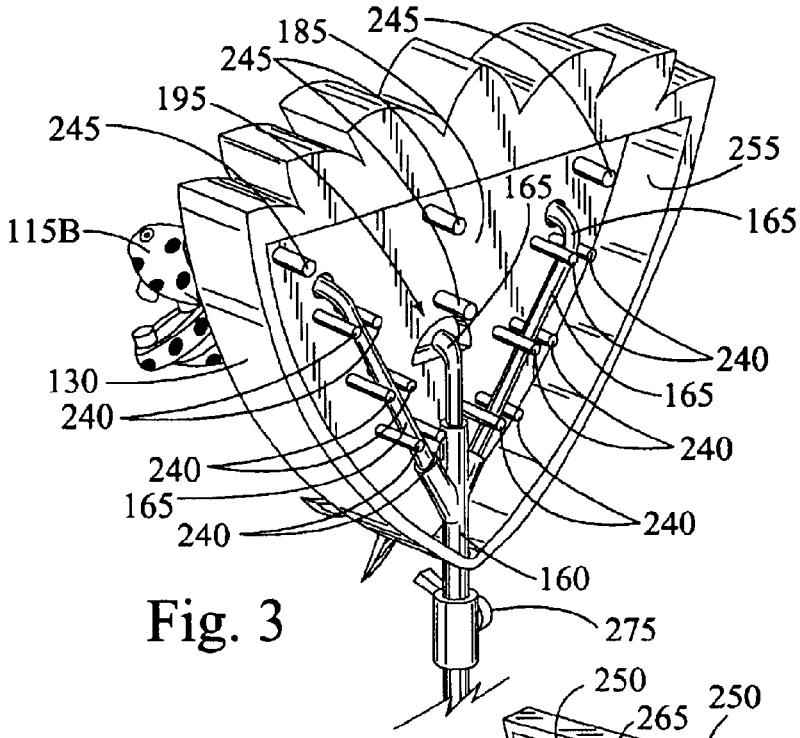
FIG. 3 is an isometric rear view of a faceplate of the faceplate assembly illustrating the routing of fluid flow conduit to the various water features.
Figure 4:
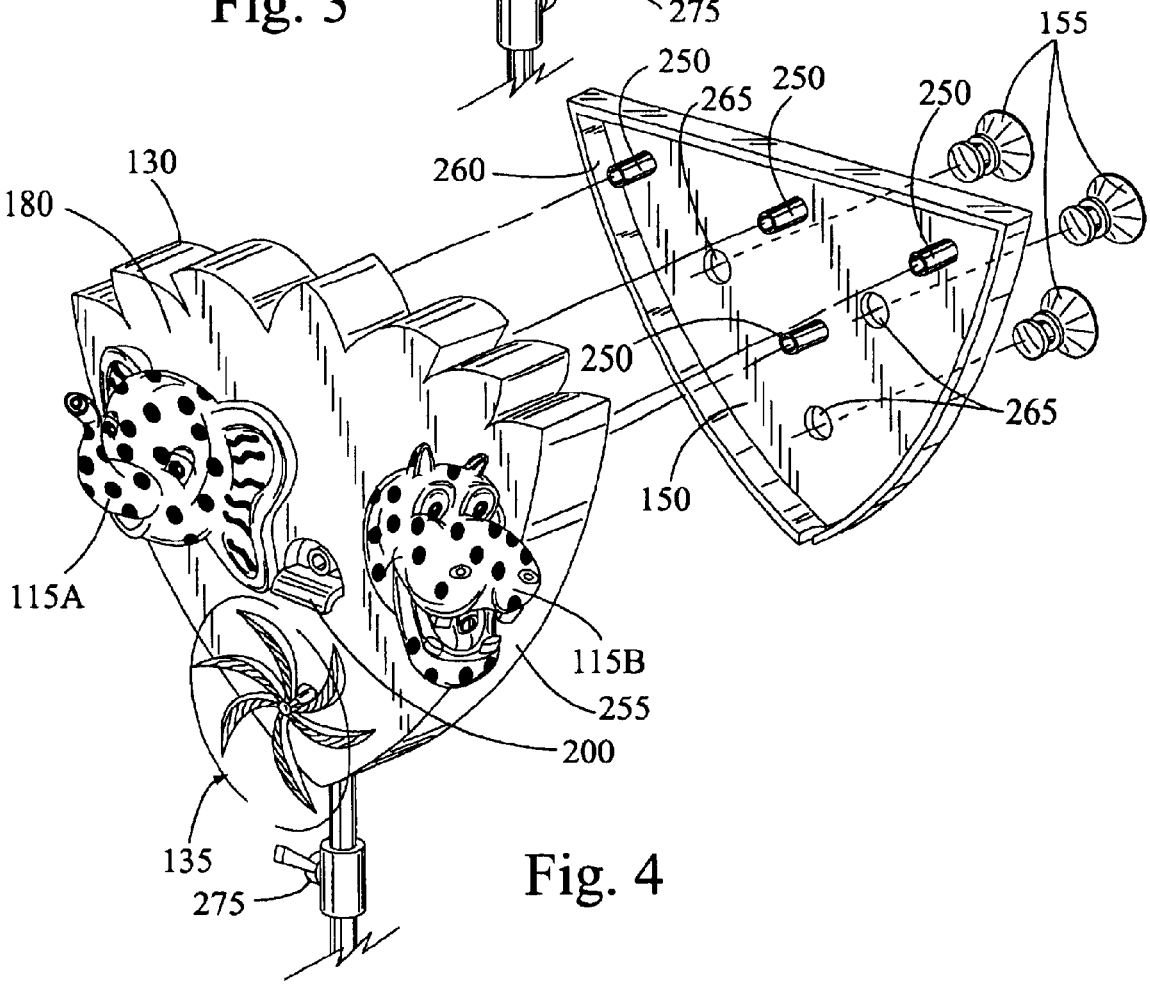
FIG. 4 is an exploded isometric front view of the faceplate assembly showing how the various components thereof fit together.

As illustrated in FIGS. 3 & 4, the faceplate assembly of the preferred embodiment typically includes (1) the faceplate 130, (2) various combinations of characters 135, 115A&B, (3) a mounting plate 150, (4) one or more attachment mechanisms (or connectors) such as suction cups 155 to secure the assembly to a vertical surface, (4) a fluid flow junction 160 for coupling to the fluid supply tubing 125, and (5) additional fluid flow conduit 165 coupling the junction with the water features 110 associated with one or more of the characters.

The faceplate 130 is typically molded from a rigid or semi rigid plastic material into a particular shape as dictated by a particular theme. In variations, other materials can be utilized in place of the rigid or semi rigid plastic such as elastomers, foam, wood and metal. The faceplate includes a front face 180 with which a user interacts with the toy and a rear face 185 for joining with the mounting plate 150. The front face of the faceplate includes mounts 175 for attaching the one or more characters 115 to the faceplate. In the preferred embodiment, the mounts are generally conically shaped and integrally molded with the rest of the faceplate. The mounts also have a passage extending down the center of the mount from the rear face 185 and out the front face at a water outlet (or spout) 170 to form at least part of a user interactive water feature 110. The fluid flow conduit 165 for the associated water feature is either received into the passage or is received at least partially therein to facilitate the flow of water therethrough. Additionally, a post 190 on to which the center of the waterwheel 135 is rotatably received is typically integrally molded in the faceplate.

In one variation of the faceplate as shown in FIGS. 2–4, a waterfall water feature 195 is provided on the front face 180 wherein water flows from an associated fluid flow conduit 165 and over a curved planer element 200 that directs water on to the waterwheel character 135 causing it to rotate. In another variation as shown in FIG. 1, a reservoir 205 having an outlet hole 210 located underneath the reservoir and directly above the waterwheel is provided. The reservoir can be integrally molded with the faceplate or it can be separately molded and subsequently attached to the front face thereof. Operationally, when a user manually fills the reservoir with water, water flows from the outlet hole to impact the vanes 140 of the waterwheel causing it to rotate. In yet another variation, the water feature associated with the waterwheel may be omitted.

Figure 2A:
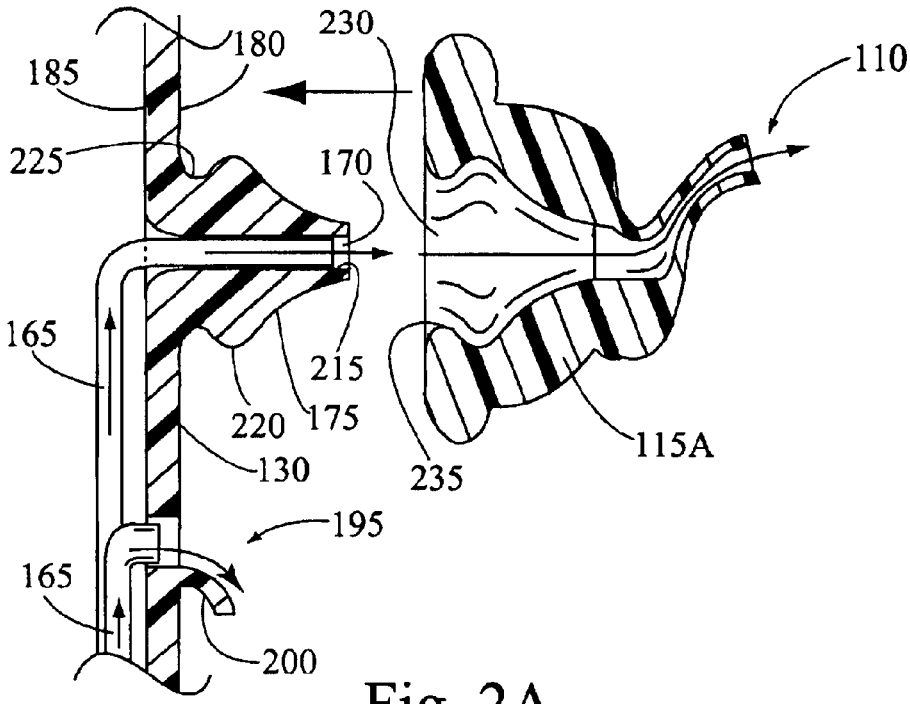
FIG. 2A is a partial cross sectional view of a removable character and its associated mount on the faceplate assembly as taken from FIG. 2.

The conical mount 175 is adapted to securely hold a removable character 115 thereon while water flows through the mount and the associated character to form a water feature. As best illustrated in FIG. 2A, the conical mount is generally conically shaped extending from a small diameter end 215 at an associated water outlet 170 to a larger diameter rounded annular ridge 220 at a location intermediate the water outlet and the front face 180 of the faceplate 105. Between the apex of the annular ridge and the front surface of the faceplate the diameter of the mount decreases to form an annular valley 225. The removable characters 115 associated with the water toy have depressions formed into their backsides that substantially correspond to the conical mounts. Further, the characters are typically comprised of a flexible pliable or elastomeric polymeric material. Accordingly, an annular ridge 235 of the depression in the removable character is snapably received within the annular valley of the mount and is securely held in place by the annular ridge of the mount. In variations and other alternative embodiments of the water toy and the faceplate assembly, different types of mounts can be utilized as would be obvious to one of ordinary skill in the art given the benefit of this disclosure. For instance, a keyed mount could be utilized wherein a pliable or a rigid character is slid on to a mounting post in a first orientation and rotated to a second orientation to secure it in place. In other variations, the character may fit wholly over the mount such that the fluid flow conduit 165 or the passage way in the mount extends generally through the character and when in operation, the water exiting the outlet 170 does not contact or flow through the character directly but only appears to emanate from the character. In this type of design, the flowing water will not apply a force against the character to push it off of the mount and accordingly, a simple cylindrical friction mount can be utilized.

The rear face 185 of the faceplate 130 is best illustrated in FIG. 3. The rear face includes a plurality of pairs of integrally molded posts 240 that are positioned on the rear face to receive and hold the fluid flow conduit 165 extending from the faceplate assemblies fluid flow junction to the associated water outlets 170 of the various water features 10. The rear face also includes several male or female mounting posts 245 that are adapted to mate with corresponding female or male posts 250 on the mounting plate. The fluid flow junction 160 is typically situated at the base of the faceplate at the rear face thereof and includes (1) an inlet for attaching to the fluid flow tubing running from the pump, and (2) two or more outlets to which the fluid flow conduit running to each water feature is attached.

In variations of the faceplate 130, the fluid flow conduit 165 and the junction 160 can be integrally molded into or with the faceplate thus reducing the number of parts required to produce the faceplate. In other variations, the manner in which the faceplate and the mounting plate 150 are joined can vary. For instance, instead of corresponding male and female mounting posts 245 & 250, the plates can nest together along corresponding sidewalls 255 & 260 and be adhesively or fusion joined at these interfaces. In another variation, the faceplate can have larger posts extending from its rear face 185 with receptacles extending into the posts to directly receive the suction cups 155 used to mount the faceplate assembly 105 to a vertical surface, thereby eliminating the need for the mounting plate altogether.

The mounting plate 150 is best illustrated in FIG. 4. Similar to the faceplate 130, the mounting plate is typically molded from a rigid or semi rigid plastic material into a particular shape as dictated by a particular theme. In variations, other materials can be utilized in place of the rigid or semi rigid plastic such as wood and metal. Essentially, the mounting plate comprises female or male-mounting posts 250 to interface with the corresponding posts 245 on the faceplate. During assembly, as the plates are brought together, the male versions of the posts are received into the openings of the female versions of the posts. The corresponding posts can hold the plates together via a friction bond, they can be solvent, heat or ultrasonically welded, or they can be adhesively joined. The mounting plate also has several holes 265 arranged on it into which the ends of the suction cups 155 can be attached. The suction cups 155 permit the faceplate assembly 105 to be attached to a generally vertical surface comprised of a smooth nonporous material, such as the sides of a bathtub, bathtub enclosure or pool.

In variations of the mounting plate 150, other types of attachment mechanisms (or connectors) can be used in place of the suction cups as would be obvious to one of ordinary skill in the art given the benefit of this disclosure. For instance, the mounting bracket could include slotted holes that fit over screws or similar fasteners that are embedded in a wall. Alternatively, the mounting plate could have half of a hook and loop material attached to it to correspond to the other half of a hook and loop material that is secured to a wall or other vertical surface. In other variations of the mounting plate and the faceplate assembly 105, the fluid flow conduit 165 could be routed on the mounting plate instead of the faceplate, or fluid passages could be at least partially integrally molded into the mounting plate with sections of tubing spanning between the terminus of each passage and the water outlets associated with a particular water feature 110.

Referring to FIGS. 1–4, various removable characters 115 are shown. As discussed above, the removable characters of the preferred embodiment are integrated with the water features 110 in such a manner that (1) water streams, flows or is sprayed from the characters, or (2) water appears to stream, flow or be sprayed from the characters. In the preferred embodiments, the characters are interchangeable from one conical mount 175 to another. Accordingly, the positions of the elephant and the hippopotamus can be reversed on the faceplate 130. Perhaps more significantly, other characters can replace the elephant and the hippopotamus. For instance, a consumer may be able to purchase the toy with two or three removable characters, but additional packs of characters may be available for purchase separately. By being able to change the characters on a periodic basis a caregiver can help ensure the water toy 100 remains interesting to a child. For example, a caregiver may be able to purchase a monkey head and a gorilla head to replace those supplied with the toy. Further, the point of exit of the stream of water from the characters can comprise different nozzles so that one character, such as the elephant, may produce a single stream of water and another character, such as the hippopotamus, may produce a multi-stream spray. Alternatively, different types of nozzles can be attached proximate the ends of the water outlets 170.

While the advantages of having removable characters 115 are appreciated, in lower cost variations of the faceplate assembly 105 the characters can be integrally molded with the faceplate. Further, in addition to the removable characters that are attachable to a mount 175 on the faceplate, other types of characters may be provided with the faceplate assembly. For instance the waterwheel character 135 of the first preferred embodiment is rotatably affixed to the post 190 molded into the faceplate and is not typically intended to be removable.

The faceplate assembly 105 is fluidly coupled to the battery-powered pump 120 by way of fluid conduit typically comprising flexible plastic tubing 125. The length of the tubing can vary but is generally between 1.5 feet and 5 feet in total length. In the preferred embodiment, the tubing is easily connectable and disconnectable from either or both the pump outlet 270 and the junction 160 of the faceplate assembly. As illustrated in FIGS. 2, 3 & 4, a valve can be provided in line with the tubing, thereby permitting the user to adjust the flow of water to the faceplate assembly and the various water features 110. In other variations, such as shown in FIG. 1, no valve is provided. In yet other variations of the water toy, one or more valves can be provided in line with one or more of the fluid flow conduits 165 extending between the junction and the various water features so that the flow to one or more of the water features can be independently adjusted.

The battery-powered at least partially submersible pump 120 is illustrated in FIGS. 1 and 2. The pump typically requires only low voltage to operate, preferably less than 9 volts, and more preferably 6 volts or less. Additionally, the current drain characteristics are such that a child, adult or animal in the pool of water with the pump would not be risking being electrocuted or even severely shocked if the pumps housing 280 were breached and the batteries 285 contained therein were directly exposed to the water. Typical types of batteries meeting the current drain limit requirements include regularly available consumer batteries such as commonly available AAA, AA, C, D, 9-volt, and lantern battery configurations of various technologies including, but not limited to dry cells, alkaline cells, NiCad cells, NIMH cells.

Preferably, the pump 120 has a pumping capacity of (1) at least 175 gallons per hour (GPH) and more preferably 200 GPH when the pump head (or water outlet(s)) is level with the pump outlet 270, and (2) greater than a 100 GPH and more preferably at least 125 GPH with a pump head of two feet or less. Of course, depending on the size of the fluid flow conduits 165 and tubing 125, the outlets 170 of the water features 110, and the number of water features, the desired pumping capacity of an associated pump can vary and can be of a greater or a lesser capacity.

Although the particular brand and style of pump 120 is not considered particularly important to the first preferred embodiment, one pump that has the desired characteristics is the Attwood model 4140-4 WaterBuster® pump made by Attwood Corporation of Lowell, Mich. The WaterBuster® pump is an impeller type pump that is powered by three Dwells and has a runtime of about 5 hours when using alkaline batteries. Furthermore, the WaterBuster® pump is fully submersible.

Referring to FIG. 1, a pump 120 having a similar, but not identical configuration as the Attwood WaterBuster® pump is illustrated. The pump includes a battery compartment 290 for containing 2–4 C or D sized batteries 285 to provide a total voltage of 3–6 volts. The pumps motor (not shown) is located within the pump housing 280 below the battery compartment and is coupled with an impeller (not shown) providing for the flow of water. In order to keep the pump in contact with the bottom surface of the bathtub or other body of water, the base of the pump can be weighted. Alternatively, as shown in FIG. 2, one or more suction cups 295 can be provided on the bottom of the pump to secure it to a bottom surface that is substantially nonporous and smooth. The housing of the pump can be formed into fanciful shapes to either help it blend into the surroundings or appear more toy-like. For instance, the top portion 300 of the pump housing shown in FIG. 2 resembles a wave. In other variations, the housing can resemble any number of features including, but not limited to, a shell, a desert island, and a sea creature.

While in the preferred embodiment the pump 120 is at least partially submersible and rests in the water, in other variations of the water toy 100, the pump can be positioned outside of the water, such as on the edge of a tub or pool, wherein another fluid flow conduit extends from the pump to the pool of water to suck water therefrom. In another variation, the pump can be integrated into the faceplate assembly 105 behind the faceplate 130.

A Second Preferred Embodiment

Figure 5:
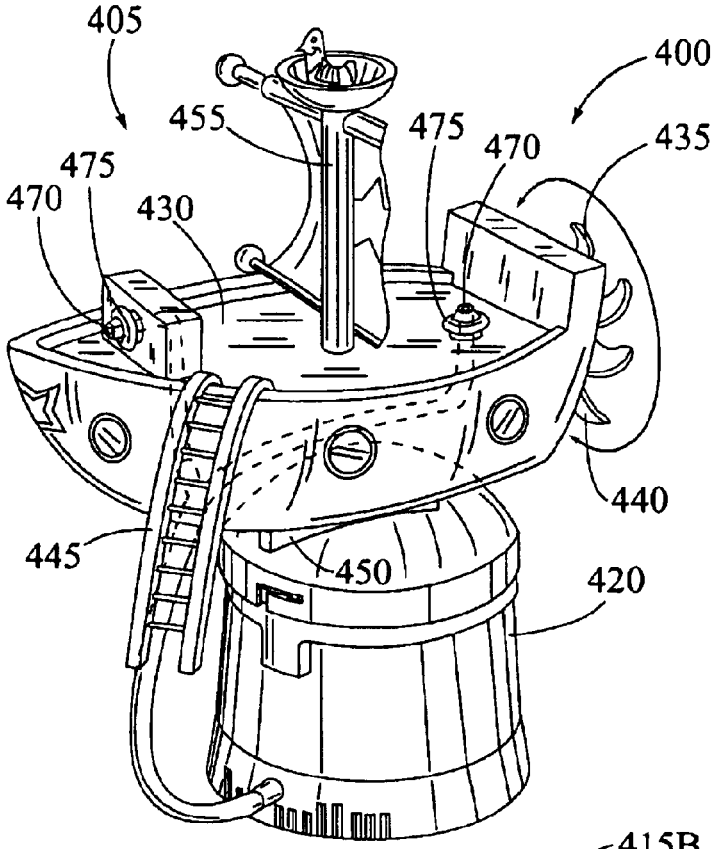
FIGS. 5 & 6 are isometric view of a second preferred embodiment of the present invention comprising a pump and an activity center that rests and/or is attached to the pump to create a freestanding toy.
Figure 6:
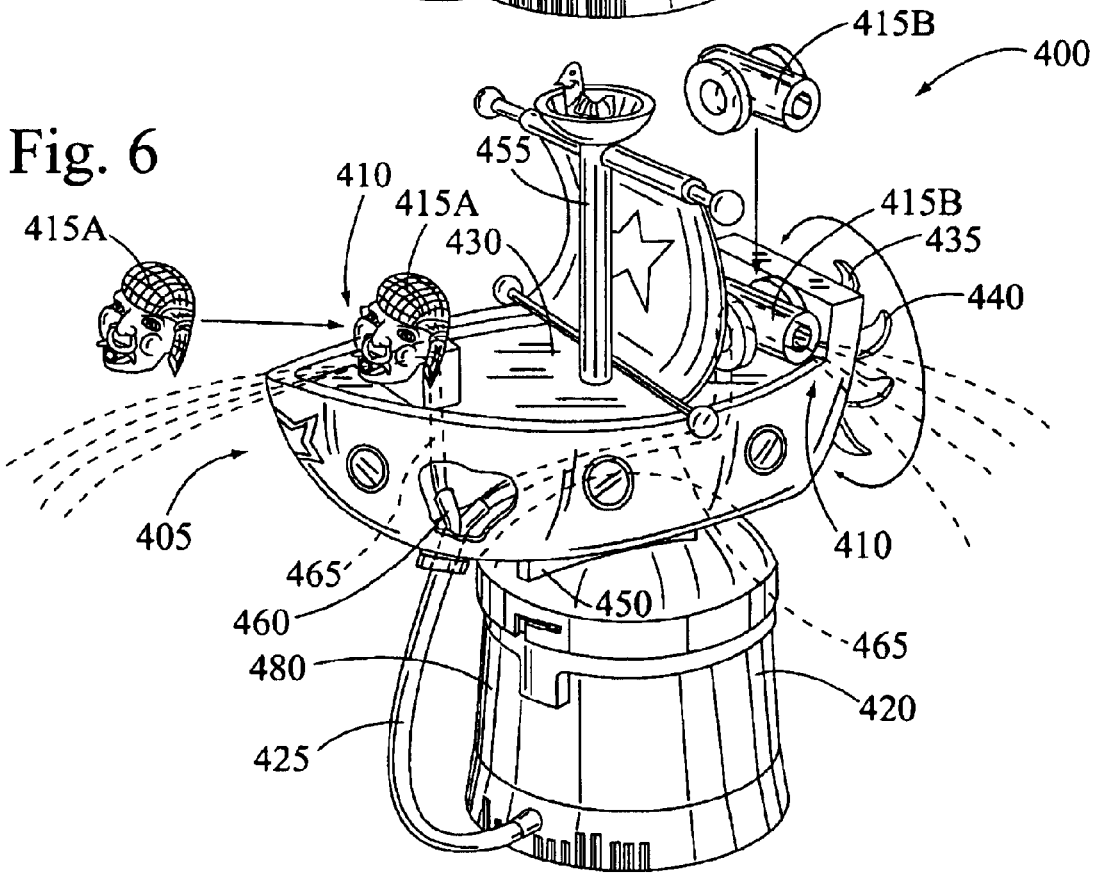

A second preferred embodiment 400 of the present invention comprising an activity center and pump combination that is free standing is illustrated in FIGS. 5 & 6. Specifically referencing FIG. 5, the second preferred embodiment generally comprises: the amusement assembly/activity center 405 including water features 41 0 and removable characters 415; the separate battery-powered fluid pump 420 that is at least partially submersible in water; and tubing 425 connecting the activity center and its water features to the pump. The activity center is typically adapted to couple and/or attach to the top of the housing of the pump. In operation, water from a pool in which the pump is positioned is pumped through the tubing to the activity center and out of the activity center through the outlets (or spouts) 470 of one or more of the water features.

The typical activity center 405 is configured to represent a particular theme in a fanciful manner. For instance, in the illustrated embodiment, a pirate theme is presented comprising a base portion 430 shaped to resemble a pirate ship, a waterwheel character 435 having vanes 440, and removable characters 415A & 415B resembling an pirate head and a canon respectively. Many other themes are contemplated including, but not limited to: a dinosaur valley theme with a volcano and dinosaur-shaped characters; a crazy flower pot theme with flower-faced characters and a flower water wheel; and a tea party theme with tea cup and teapot characters.

As illustrated in FIGS. 5 & 6, the activity center of the preferred embodiment typically includes (1) the base portion 430, (2) various combinations of characters 435, 415A&B, (3) a mounting device 450 to join the activity center and the pump, (4) a fluid flow junction 460 for coupling to the fluid supply tubing 425, and additional fluid flow conduit 465 coupling the junction with the water features 410 associated with one or more of the characters.

Similar to the faceplate 130 of the faceplate assembly 130, the base portion 430 of the activity center is typically molded from a semi-rigid or rigid plastic material. In variations, other materials can be utilized in place of the rigid or semi rigid plastic such as elastomers, foam, wood and metal. The base portion can also comprise several pieces that are fitted together. For instance, the mast 455 and the ladder 445 of the pirate ship can be separately molded and subsequently snapped, bonded or fusion welded to the ship's hull and deck. Alternatively, the base portion and most of its components can be integrally molded.

Typically, the base portion 430 also comprises one or more character mounts 475 substantially similar to those described above concerning the first preferred embodiment The mounts are generally conically shaped and integrally molded with the rest of the base portion. The mounts also have a passage extending down each of their centers and out an end thereof at a water outlet (or spout) 470 to form at least part of an associated user interactive water feature 410. The fluid flow conduit 465 for the associated water feature is either received into the passage or is received at least partially therein to facilitate the flow of water therethrough.

The base portion 430 can also include the aforementioned mounting device 450 of the activity center that interfaces with the housing of the pump to secure the activity center thereto. The mounting mechanism may comprise a slot or latch that interfaces and locks with a corresponding latch or slot in the pump housing. Alternatively, the mounting mechanism could comprise a suction cup (not shown) that is secured to the base portion and attaches to a smooth top portion of the pump housing.

Numerous variations of the base portion 430 are contemplated and in many respects can be dependent on the theme of the activity center. Many of the possible variations are similar to those discussed above concerning the faceplate 130 and the faceplate assembly 105, such as integrally molding the fluid flow junction and or fluid flow conduit into the base portion to avoid the use of separate pieces of tubing.

The removable characters 415 are also substantially similar in design and construction as the removable figures 115 described above. The characters from either embodiment typically share the same mounting system making them interchangeable.

Finally, the pump 420 utilized with the second preferred embodiment is substantially similar to the pump 120 described in reference to the first preferred embodiment. The same pump can be used interchangeably wherein a user of the toy can first purchase an embodiment including one of the faceplate assembly or activity center 405 and later purchase the other of the faceplate assembly or the activity center to use with the originally purchased pump. Further, as with the first preferred embodiment, one or more valves (not shown in this embodiment) can be provided to control the flow of water.

Alternative Embodiments and Other Variations

The embodiments of the water toy as illustrated in the accompanying figures and described above are merely exemplary and are not meant to limit the scope of the invention. It is to be appreciated that numerous variations to the invention have been contemplated as would be obvious to one of ordinary skill in the art with the benefit of this disclosure. All variations of the invention that read upon the appended claims are intended and contemplated to be within the scope of the invention.

For instance, although the water toy has been described in terms of a faceplate assembly embodiment and a freestanding activity center embodiment, other embodiments are contemplated. For instance, a free-floating embodiment is also contemplated wherein the activity center comprises a toy boat (or floating island) that is coupled with the pump by way of several feet of tubing. Another embodiment of the water can comprise a combination of the two preferred embodiments or any other embodiments that are within the scope of the claims. For example, the toy could comprise a faceplate assembly 105 and a freestanding activity center 405 both having water features that are activated by the same pump 120.

We claim:

1. A water toy comprising:

an at least partially submersible battery-powered fluid pump;

a themed amusement assembly, the amusement assembly including (1) at least one spout out of which water streams when the toy is in operation; and (2) at least one character removably mounted over the at least one spout, wherein water appears to stream from the character when the toy is in operation; and a fluid conduit connecting the fluid pump and the amusement assembly.

2. The water toy of claim 1, wherein the amusement assembly comprises a faceplate assembly, the faceplate assembly being adapted for being removably secured to generally vertical surface.

3. The water toy of claim 1, wherein the amusement assembly comprises a fanciful structure adapted to couple with a top portion of the pump.

4. The water toy of claim 3, wherein the fanciful structure comprises representations of one of the following list: a pirate ship; a volcano; a desert island; a boat adapted to receive dolls therein; a whale; and dolphin.

5. The water toy of claim 1, wherein the amusement assembly further includes a conically shaped mount corresponding to a conically shaped depression in the at least one character, the conically-shaped depression being adapted to be securely received over the conically-shaped mount.

6. The water toy of claim 1, wherein the at least one spout comprises two or more spouts.

7. The water toy of claim 6, wherein a first spout of the two or more spouts has a first nozzle, and a second spout of the two or more spouts has a second nozzle, and wherein the spray pattern of water flowing from the first nozzle is different from the spray pattern of water flowing from the second nozzle when the toy is in operation.

8. The water toy of claim 1, wherein the pump further comprises one or more suction cups attached to a bottom surface of the pump, the one or more suction cups being adapted to secure the pump to a generally smooth surface.

9. The water toy of claim 1, wherein the pump is an impeller-type pump.

10. The water toy of claim 1, wherein the operating voltage of the pump is less than about 6 volts.

11. The water toy of claim 1, wherein a bottom portion of the pump is weighted.

12. The water toy of claim 1, wherein the pump has a maximum flow rating in excess of about 175 gallons per hour.

13. A water toy comprising:

a battery-operated pump;

a themed faceplate assembly separate from the pump, the faceplate assembly including (1) a faceplate, (2) one or more fluid passages terminating in an outlet, wherein the portion of the faceplate assembly immediately surrounding the outlet is configured to resemble a character, (3) one or more connectors adapted to removably secure the face plate assembly to a generally vertical surface; and tubing fluidly connecting the faceplate assembly and the pump.

14. The water toy of claim 13, wherein the pump is at least partially submersible, and includes one or more suction cups adapted to removably secure the pump to a generally smooth surface.

15. The toy of claim 13, wherein the one or more connectors comprise suction cups.

16. The toy of claim 13, wherein the portion of the faceplate assembly immediately surrounding the outlet resembling a character is removably mounted to the faceplate.

17. A water toy comprising:

an at least partially submersible battery-operated pump, the pump including one or more suction cups adapted to removably secure the pump to a surface;

a faceplate assembly, the faceplate assembly including (1) a faceplate, (2) at least one spout out of which water streams when the toy is in operation; (3) at least one character removably mounted over the at least one spout, wherein water appears to stream from the character when the toy is in operation; and (4) one or more suction cups adapted to removably secure the faceplate assembly to a generally vertical surface; and tubing fluidly coupling the faceplate assembly and the pump.

18. They water toy of claim 17, wherein an external housing of the pump has a fanciful shape.

19. The water toy of claim 17, wherein the at least one character is representative of humanoid or animal heads.

20. The water toy of claim 17, wherein the faceplate assembly further includes a conically-shaped mount corresponding to a conically-shaped depression in the at least one character, the conically-shaped depression being adapted to be securely received over the conically-shaped mount, and wherein the mounts are comprised of a generally rigid plastic material and the characters are comprised of an elastomeric material.

* * * * *